US006264030B1

(12) United States Patent
Tsou

(10) Patent No.: US 6,264,030 B1
(45) Date of Patent: Jul. 24, 2001

(54) TOOL BOX

(76) Inventor: Yao-Lin Tsou, No. 63, Gueike Rd., Fusing Tsuen, Daan Tshing, Taichung (TW)

( * ) Notice: Subject to any disclaimer, the term of this patent is extended or adjusted under 35 U.S.C. 154(b) by 18 days.

(21) Appl. No.: 09/609,701

(22) Filed: Jul. 3, 2000

(51) Int. Cl.[7] ..... B65D 85/28

(52) U.S. Cl. ..... 206/372; 220/7; 220/691; 312/902

(58) Field of Search ..... 206/349, 372–379; 211/70.6, 69; 220/4.28, 4.32–4.34, 617, 691; 312/902, 249.4, 350

(56) References Cited

U.S. PATENT DOCUMENTS 3,246,828 * 4/1966 Branscum et al. ..... 220/6
4,273,394 * 6/1981 Chandler ..... 206/349
4,662,515 * 5/1987 Newby, Sr. ..... 206/349
5,458,238 * 10/1995 Dominguez-Gutierrez ..... 220/7
6,047,841 * 4/2000 Chen ..... 220/7
6,105,769 * 8/2000 Chen ..... 206/372

* cited by examiner

*Primary Examiner*—Luan K. Bui
(74) *Attorney, Agent, or Firm*—Rosenberg, Klein & Lee

(57) ABSTRACT

A tool box includes a first part and a second part. The first part is composed of two boards foldably connected with each other and in a form of L-shaped part. The second part is composed of three boards pivotally connected with each other and in a form of an U-shaped member. The second part is mounted to the first part by engaging connection rods on the first part with recesses in the second part so as to form a tool box with an opening defined in a front side of the tool box. A plurality of drawers slidably engaged with rails on two insides of the second part from the front opening.

2 Claims, 4 Drawing Sheets

TOOL BOX

FIELD OF THE INVENTION

The present invention relates to a tool box which is assembled by a first part which is composed of two boards folded in a form of an L-shaped part, and a second part part which is composed of three boards folded in a form of a U-shaped part. The two parts are assembled to be a box with an open side into which drawers are slidably received.

BACKGROUND OF THE INVENTION

A conventional tool box is generally includes a box-like body and a cover which is pivotally connected to the box. The box-like body and the cover are manufactured by way of blowing which employs blowing machine to blow air into plastic material in a mold so as to form the hollowed board. The blowing process is properly suitable for manufacturing tool boxes having simple structure as described above. However, tool boxes nowadays are required to include multiple layers so as to receive more tools or bits. The multiple-layer tool box needs more molds and the molds have complicated figures, this usually costs a lot.

The present invention intends to provide a tool box which is assembled by two foldable parts and each part includes two or three boards. The boards are connected with each other by engaging projections in one board with recesses in another board.

SUMMARY OF THE INVENTION

In accordance with one aspect of the present invention, there is provided a tool box and comprising a first part having a first board and a second board which is pivotally connected to the first board. The first part is in a form of an L-shaped part. The second part comprises a middle board with a third board and a fourth board respectively connected to tow sides of the middle board. The second part is in a form of an L-shaped part. The first part is engaged with the second part to form a box with a front opening. A plurality of drawers are slidably received in the tool box via the front opening and are moved along rails on the insides of the third board and the fourth board.

The primary object of the present invention is to provide a tool box that is composed of an L-shaped first part and a U-shaped second part. Each of the first part and the second part is made by way of blowing by a simple mold so that the cost for manufacturing the tool box is low.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
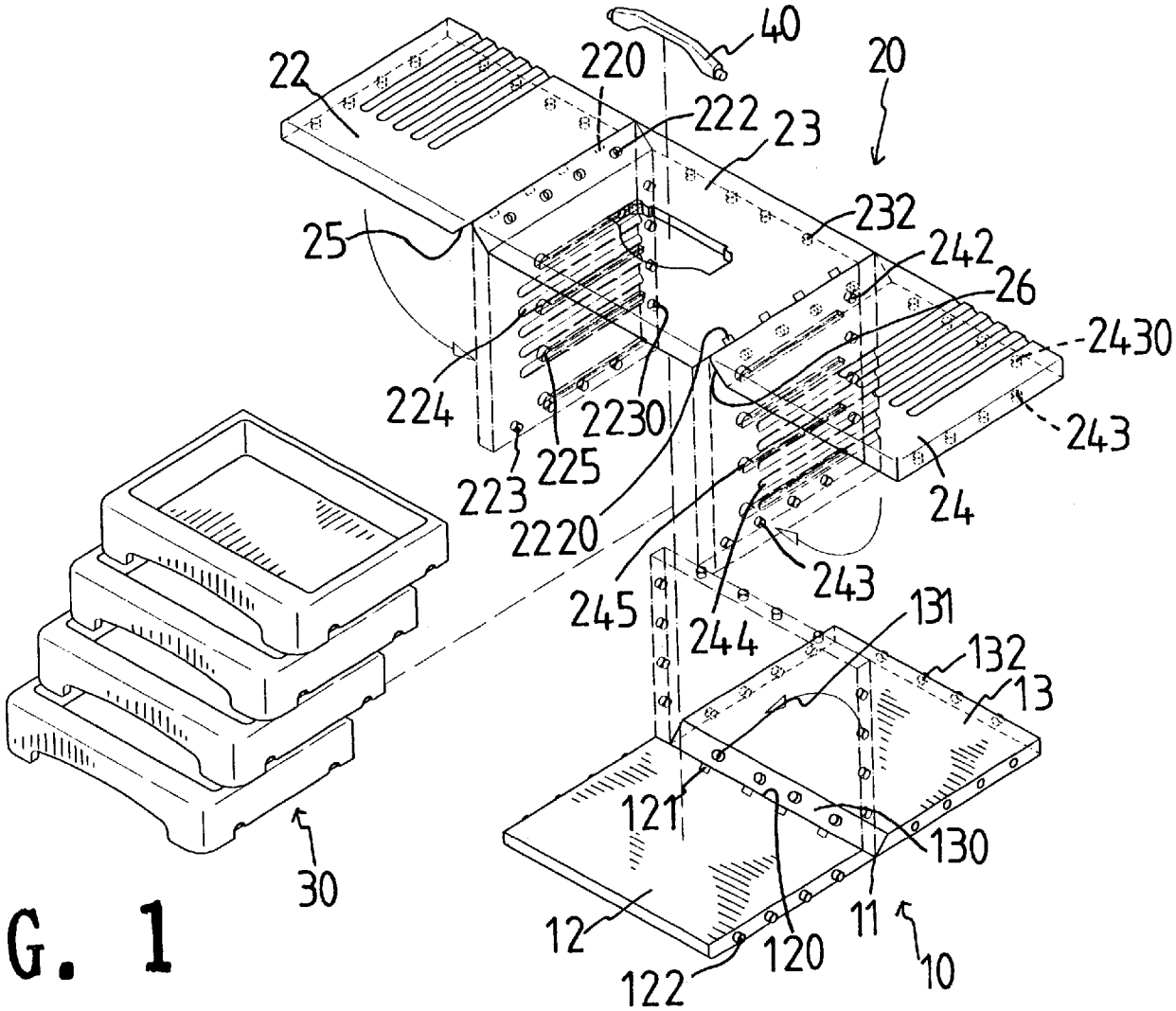
FIG. 1 is an exploded view to show the parts composing a tool box of the present invention.
Figure 2:
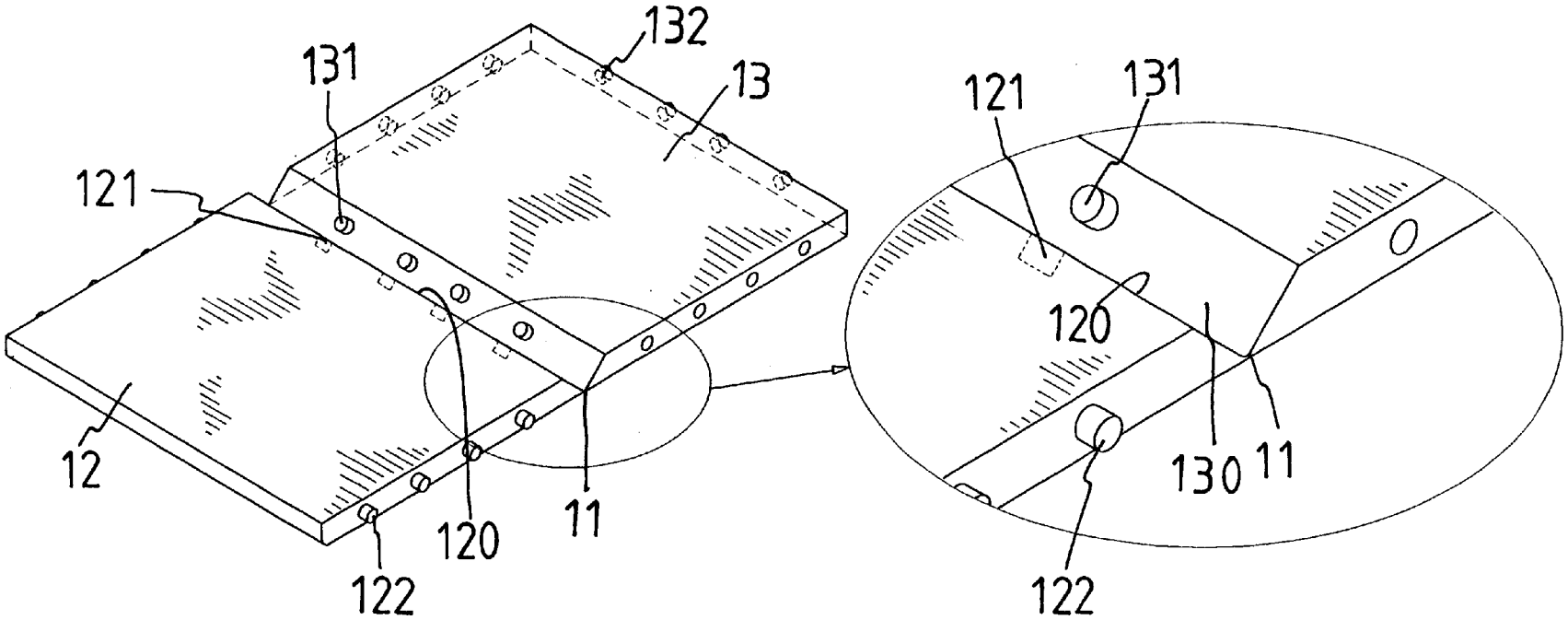
FIG. 2 is a perspective view to show a first part of the tool box of the present invention.
Figure 3:
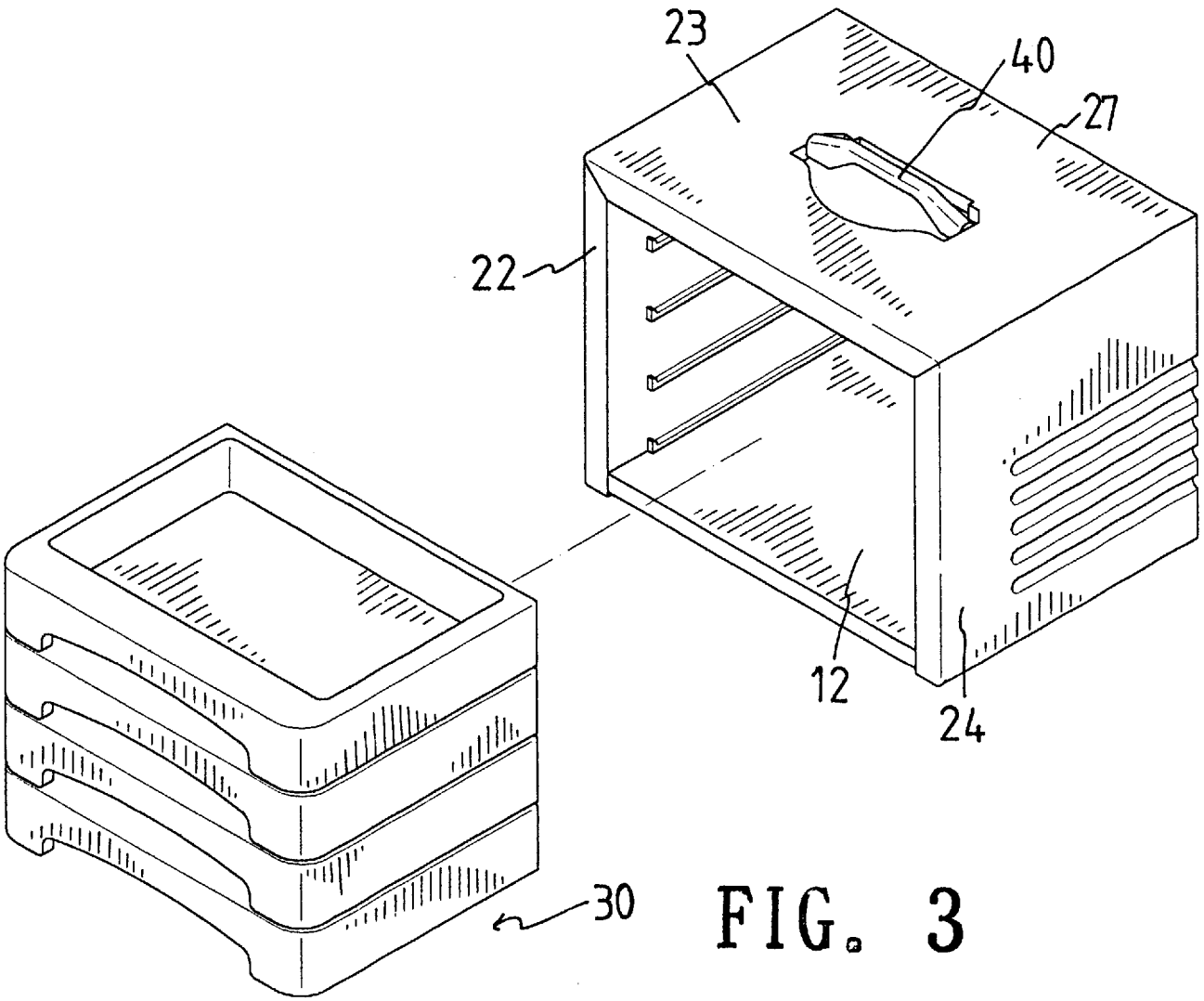
FIG. 3 is an exploded view to show the tool box and drawings of the present invention.
Figure 4:
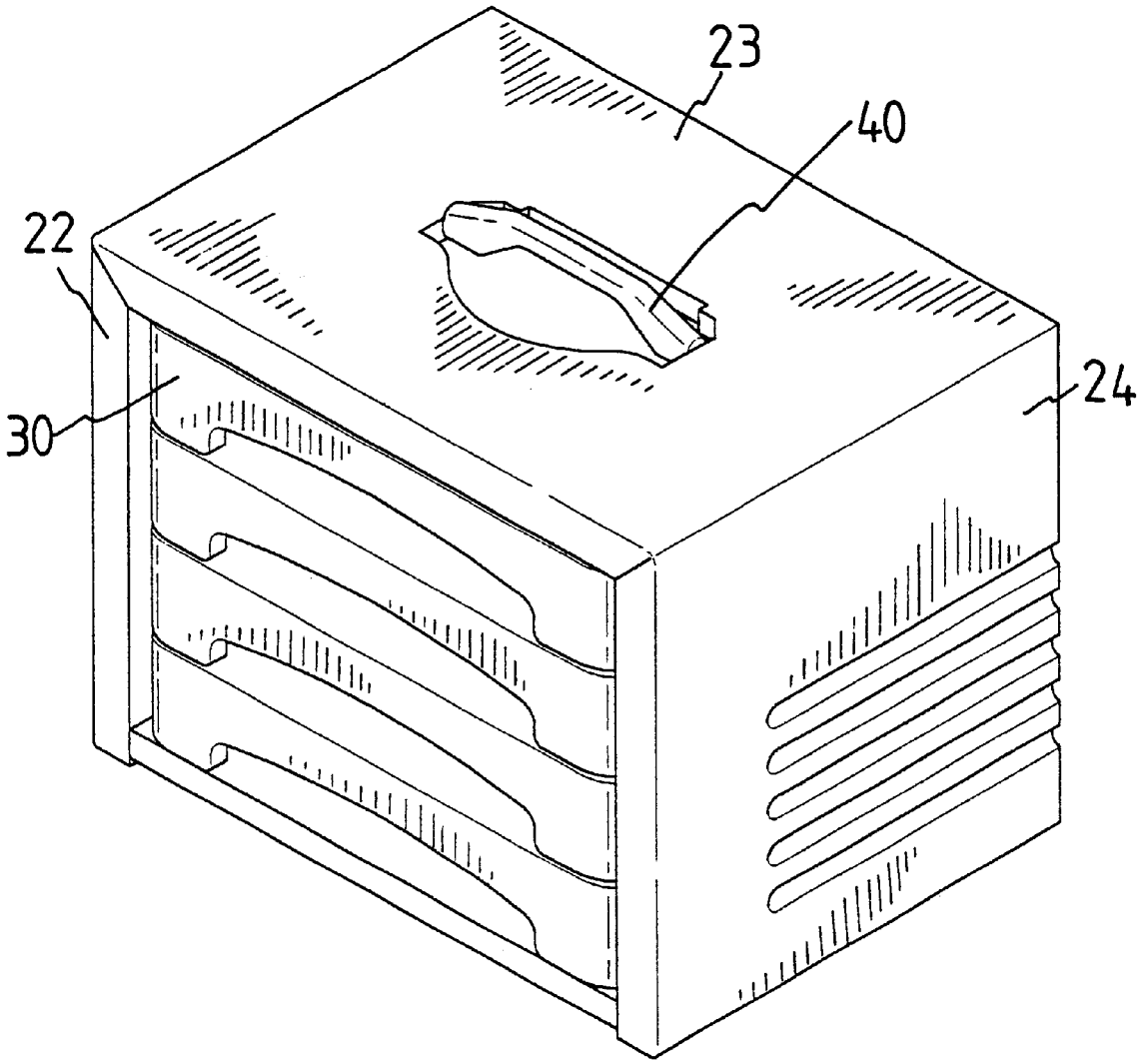
FIG. 4 is a perspective view to show the tool box with drawers received in the tool box.

Referring to FIGS. 1 to 3, the tool box of the present invention comprises a first part 10 and a second part 20. The first part has a first board 12 and a second board 13, and a first inclined surface 120 is defined in a side of the first board 12 and a second inclined surface 130 is defined in a side of the second board 13. A connection portion 11 connects an edge of the first inclined surface 120 and an edge of the second inclined surface 130. A plurality of first projections 131 extend from the second inclined surface 130 and a plurality of first recesses 121 are defined in the first inclined surface 120 so that the first projections 130 are engaged with the first recesses 121 when the first inclined surface 120 matches with the second inclined surface 130. Therefore, the first part 10 is an L-shaped part. A plurality of second projections 122 extend from two sides of the first board 12 the first inclined surface 120 connected between the two sides having the second projections 122. A plurality of second recesses 132 are defined in the other three sides of the second board 13.

The second part 20 has a middle board 23 with a third board 22 and a fourth board 24 respectively connected to two sides of the middle board 23. A first side of the middle board 23 is a third inclined surface and a plurality of third recesses 222 are defined in the third inclined surface of the middle board 23. A second side of the middle board 23 is a fourth inclined surface and a plurality of fourth recesses 2220 are defined in the fourth inclined surface of the middle board 23. The third board 22 has a fifth inclined surface 25 which is connected to the first side of the middle board 23. A plurality of third projections 220 extend from the fifth inclined surface 25. The fifth inclined surface 25 is matched with the third inclined surface of the middle board 23 and the third projections 220 are engaged with the third recesses 222. A plurality of rails 225 extend from an inside of the third board 22.

The fourth board 24 has a sixth inclined surface 26 which is connected to the second side of the middle board 23. A plurality of fourth projections 242 extend from the sixth inclined surface 26. The sixth inclined surface 26 is matched with the fourth inclined surface of the middle board 23 and the fourth projections 242 are engaged with the fourth recesses 2220. A plurality of rails 245 extend from an inside of the fourth board 24. Therefore, the second part is in a form of U-shaped part. The third board 22 has a plurality of first connection recesses 223 defined in a distal side opposite to the fifth inclined surface 25 of the third board 22. A plurality of first connection rods 2230 extend from a side connected between the fifth inclined surface 25 and the distal side of the third board. 22. The fourth board 24 has a plurality of second connection recesses 243 defined in a distal side opposite to the sixth inclined surface 26 of the fourth board 24. A plurality of second connection rods 2430 extend from a side connected between the sixth inclined surface 26 and the distal side of the fourth board 24.

The first board 12 is connected between the third board 22 and the fourth board 24 by engaging the second projections on the first board 12 with the first connection recesses 223 in the third board 22 and the second connection recesses 243 in the fourth board 24 respectively. The second board 13 is connected between the third board 22 and the fourth board 24 by engaging the first connection rods 2230 on the third board 22 and the second connection rods 2430 on the fourth board 24 with the second recesses 132 in the second board 13. By this way, a box with a front opening is formed. A handle connection to an outside of the middle board 23.

A plurality of drawers 30 are slidably supported between the rails 225 and 245 on the third board 22 and the fourth board 24. Each of the boards 12, 13, 22, 23 and 24 is made by way of blowing and the boards 12, 13, 22, 23 and 24 each have a simple structure so that their molds are cheap and simple.

While we have shown and described various embodiments in accordance with the present invention, it should be clear to those skilled in the art that further embodiments may be made without departing from the scope and spirit of the present invention.

What is claimed is:

1. A tool box comprising:

a first part having a first board and a second board, a first inclined surface defined in a side of said first board and a second inclined surface defined in a side of said second board, a connection portion connecting an edge of said first inclined surface and an edge of said second inclined surface, a plurality of first projections extending from said second inclined surface and a plurality of first recesses defined in said first inclined surface, said first projections engaged with said first recesses when said first inclined surface matches with said second inclined surface, a plurality of second projections extending from two sides of said first board, said first inclined surface connected between said two sides having said second projections, a plurality of second recesses defined in the other three sides of said second board;

a second part having a middle board and a first side of said middle board being a third inclined surface and a plurality of third recesses defined in said third inclined surface of said middle board, a second side of said middle board being a fourth inclined surface and a plurality of fourth recesses defined in said fourth inclined surface of said middle board, a third board having a fifth inclined surface which is connected to said first side of said middle board, a plurality of third projections extending from said fifth inclined surface, said fifth inclined surface matched with said third inclined surface of said middle board and said third projections engaged with said third recesses, a fourth board having a sixth inclined surface which is connected to said second side of said middle board, a plurality of fourth projections extending from said sixth inclined surface, said sixth inclined surface matched with said fourth inclined surface of said middle board and said fourth projections engaged with said fourth recesses, said third board having a plurality of first connection recesses defined in a distal side opposite to said fifth inclined surface of said third board, a plurality of first connection rods extending from a side connected between said fifth inclined surface and said distal side of said third board, said fourth board having a plurality of second connection recesses defined in a distal side opposite to said sixth inclined surface of said fourth board, a plurality of second connection rods extending from a side connected between said sixth inclined surface and said distal side of said fourth board;

said first board connected between said third board and said fourth board by engaging said second projections on said first board with said first connection recesses in said third board and said second connection recesses in said fourth board respectively;

said second board connected between said third board and said fourth board by engaging said first connection rods on said third board and said second connection rods on said fourth board with said second recesses in said second board, and a handle connection to an outside of said middle board.

2. The tool box as claimed in claim 1, wherein each of said third board and said fourth board has a plurality of rails extending therefrom, a plurality of drawers slidably engaged between said rails.

* * * * *